US007123550B2

(12) United States Patent
Galli

(10) Patent No.: US 7,123,550 B2
(45) **Date of Patent: *Oct. 17, 2006**

(54) ASSEMBLY AND METHOD FOR ILLUMINATING A WATCH

(76) Inventor: Robert D. Galli, 8175 Horseshoe Bend La., Las Vegas, NV (US) 89113

( * ) Notice: Subject to any disclaimer, the term of this patent is extended or adjusted under 35 U.S.C. 154(b) by 204 days.

This patent is subject to a terminal disclaimer.

(21) Appl. No.: 10/808,869

(22) Filed: Mar. 25, 2004

(65) Prior Publication Data

US 2005/0018546 A1 Jan. 27, 2005

Related U.S. Application Data

(63) Continuation-in-part of application No. 10/360,781, filed on Jul. 23, 2003, now Pat. No. 7,023,763.

(60) Provisional application No. 60/459,343, filed on Apr. 1, 2003.

(51) Int. Cl.
*G04B 19/04* (2006.01)
*G04B 19/06* (2006.01)

(52) U.S. Cl. ..... 368/227; 368/10; 368/226

(58) Field of Classification Search ..... 368/10, 368/67, 227, 285, 294, 295, 278
See application file for complete search history.

(56) References Cited

U.S. PATENT DOCUMENTS

| | | | | |
|---|---|---|---|---|
| 4,115,994 | A | 9/1978 | Tomlinson | 58/50 |
| 4,417,819 | A | 11/1983 | Migeon | 368/67 |
| 4,561,042 | A | 12/1985 | Wehner et al. | 362/30 |
| 4,899,453 | A | 2/1990 | Bhat et al. | 33/348 |
| 4,972,394 | A | 11/1990 | DiMarco | 368/227 |
| 5,604,716 | A | 2/1997 | Cheung | 368/67 |
| 5,703,837 | A | 12/1997 | Umemoto et al. | 368/88 |
| 6,106,127 | A | 8/2000 | Fuwausa | 362/29 |
| 6,145,209 | A | 11/2000 | Chang | 33/348 |
| 6,299,321 | B1 | 10/2001 | Fuwausa | 362/29 |
| 6,729,738 | B1 | 5/2004 | Thompson et al. | 362/84 |
| 6,806,644 | B1 * | 10/2004 | Ueno et al. | 313/512 |
| 2005/0018544 | A1 * | 1/2005 | Galli | 368/67 |

* cited by examiner

*Primary Examiner*—Daniel J. Colilla
*Assistant Examiner*—Leo T. Hinze
(74) *Attorney, Agent, or Firm*—Barlow, Josephs & Holmes, Ltd.

(57) ABSTRACT

An assembly is provided that allows construction of a watch that includes multifunctional illumination options. The assembly of the present invention provides a means for illuminating the watch face, a high intensity flashlight and a watch locator beacon. The assembly overcomes the drawbacks associated with filament lamps by using LED lamps that provide greater brightness with less power consumption. Further, the present invention relies on a unique feature of LED's, whereby they are only illuminated by DC power at the right polarity to provide a compact assembly that utilized a minimum amount of space.

11 Claims, 6 Drawing Sheets

ASSEMBLY AND METHOD FOR ILLUMINATING A WATCH

CROSS-REFERENCE TO RELATED APPLICATIONS

This application is related to and claims priority from earlier filed provisional patent application No. 60/459,343, filed Apr. 1, 2003, and is a continuation in part of U.S. application Ser. No. 10/360,781, filed Jul. 23, 2003, now U.S. Pat. No. 7,023,763, issued Apr. 4, 2006.

BACKGROUND OF THE INVENTION

The present invention relates generally to illumination devices for incorporation into wristwatches. More specifically, this invention relates to a multifunction illumination assembly for incorporation into wristwatches whereby LED lighting elements are provided for use to illuminate the watch face, to act as a watch locator and to serve as a flashlight.

In the prior art, various types of illumination devices have been proposed for wristwatches to enable reading the time under poor light conditions. Primarily, the application of phosphorescent materials to watch dials has been employed with varying degrees of success and all suffering from the well-known shortcoming of being difficult to see particularly with the passage of time as the potency of the phosphorescent material decreases. In addition, the phosphorescent material requires periodic recharging through exposure to light in order for the level of phosphorescent output to be maintained. Finally, the luminous materials used in dials of the foregoing watches also lose their light emitting capacity with age and generally provide substantially less than fully satisfactory performance over time as the watch ages.

As an alternative to the use of phosphors, electric devices for watch illumination have also been employed with some limited success. Such devices usually take the form of small incandescent bulbs powered by a battery and arranged inside the case of the wristwatch. Typically the placement and arrangement of these batteries and bulbs is assisted by the further implementation of light pipes or reflectors that redirect the light output towards the watch dial thereby enabling the numerals on the dial to be seen. In other assemblies, it has been proposed to provide a small auxiliary battery outside the watchcase in a special attachment connected to the watchband. In this case, an incandescent bulb is provided in the watch crystal, which is connected to the auxiliary battery by lead wires and a switching means. Alternately, the prior art discloses an incandescent bulb installed in the exterior of the watchcase in a housing on the watchband and connected to a battery also disposed within the housing. A deformable or flexible wall allows the circuit to be closed to illuminate the dial by pressing the flexible wall.

In all of the foregoing arrangements, the lead wires passing between the power source in the watchband attachment and the incandescent bulb in the case or crystal are subject to possible malfunction, due to breakage caused by the constant and repetitive movement between the case and the attachment. Also, the arrangements described are not easily utilized as a flashlight, wherein the light is directed away from the watch dial, if such functionality is desired by the user.

Another shortcoming of many of the prior art devices is that they inefficiently rely upon a relatively powerful illumination source, which attempts to illuminate the entire area of the dial by a flood of visible light output from the source. When illuminated in this manner, the nature of the light output causes portions of the dial nearest the light source to become overly illuminated in order to provide sufficient output so that the portions of the dial that are spaced from the light source receive adequate illumination. Additionally, this approach tends to cause shadows across the watch dial that are especially pronounced when the dial includes curved surfaces or three-dimensional objects thereon. Other drawbacks of the prior known devices for providing dial illumination include the fact that they are bulky and are frequently both delicate and expensive. In general, these devices employing incandescent filament operated bulbs have not been accepted for portable devices due to the fact that they require substantial battery capacity for their operation due to their substantial power requirement. Further, these filament bulbs have a relatively short useful life span as compared to the life of the watch thereby making it necessary to provide for replacement of the bulb in the event that it burns out.

BRIEF SUMMARY OF THE INVENTION

In accordance with the present invention, an assembly is provided that allows construction of a watch, which includes multifunctional illumination options. The assembly of the present invention provides a multi functional means for illuminating the watch face, directing a high intensity flashlight beam outwardly from the watch and locating the watch via a locator beacon. The assembly overcomes the drawbacks associated with filament lamps by using LED lamps that provide greater brightness with less power consumption.

The watch face illumination function utilizes a relatively short wavelength light source to illuminate the face of the watch. The use of a short wavelength emitter has two useful purposes in the context of the present invention. First, short wavelength emitters are more effective in energizing phosphorescent materials, thereby causing a higher output of illumination of the features on the watch face for a smaller expenditure of energy input. Second, an emitter in this range is on the borderline of the visible light spectrum and has a lower impact on the users visual accommodation when the emitter is activated. Specifically, the activation of the emitter has a reduced impact on the user's "night vision".

The outwardly directed flashlight function utilizes a separate emitter with an output in the visible light range. To facilitate the creation of an easy to operate device, the same actuator that is used to operate the watch face illumination function is also used to activate the flashlight function. A logic chip is placed in the watch that monitors the duration and manner in which the actuator is depressed so that it can selectively activate the desired function. To this end, the present invention may also utilize a unique feature of LED's, whereby they are only illuminated by DC power at the right polarity to provide a compact assembly that utilized a minimum amount of space.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE INVENTION

Figure 1:
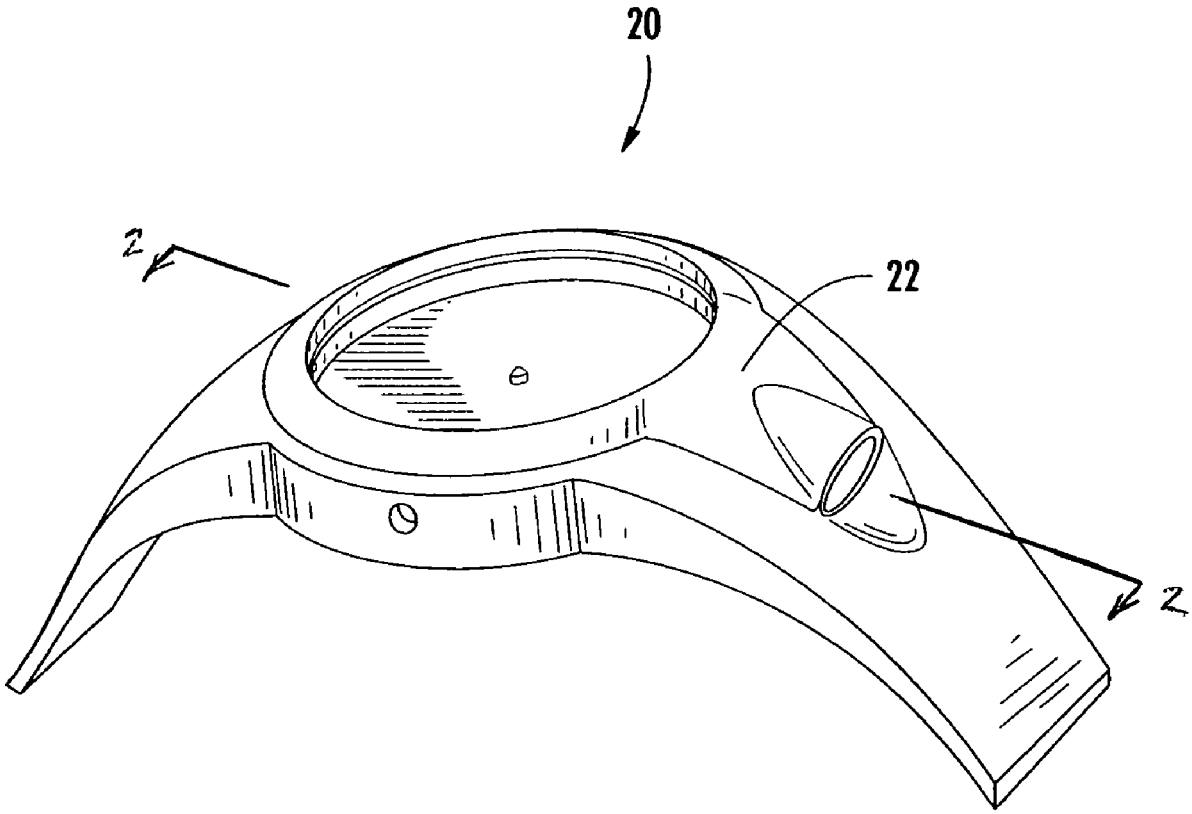
FIG. 1 is a perspective view of the illuminated watch flashlight of the present invention.

Referring now to the drawings, in general, the present invention is directed to an assembly that is installed into a watch case to provide illumination functionality for the watch. The assembly includes two major components that are installed into a watch case to provide the required functionality by utilizing a dedicated power source while remaining completely segregated from the time keeping functions of the watch.

The first component is a small circuit board 2 assembly that has a battery 4, a movable switch actuator 6 and a logic chip 8 mounted thereon. This circuit board assembly 2 is configured to fit within the back of a watch 20 without interfering with the main time keeping mechanism within the watch case. Further, a second assembly 10 is provided to support LED elements that provide the required illumination functions.

Figure 2:
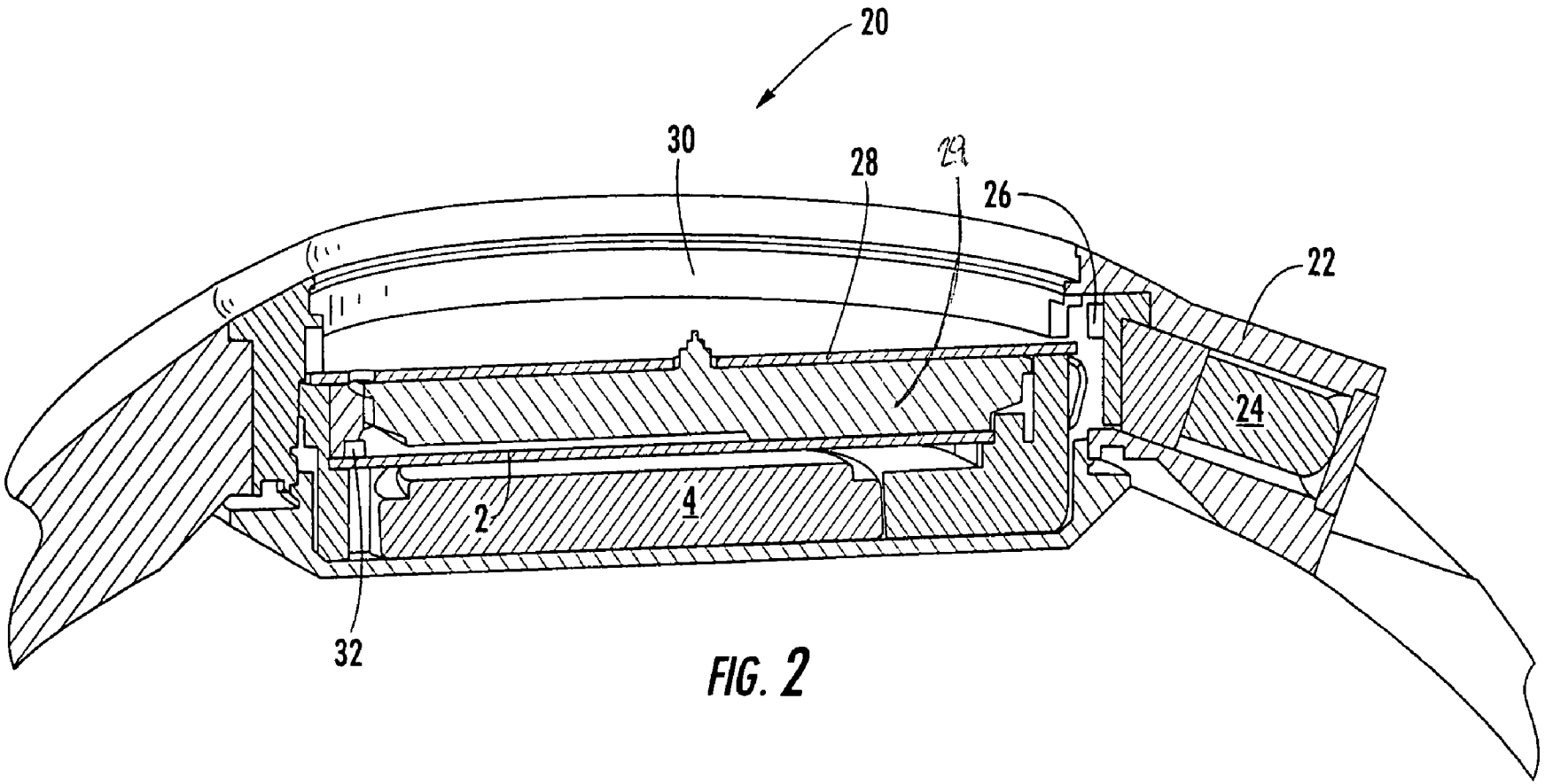
FIG. 2 is a cross-sectional view thereof taken along the line 2—2 of FIG. 1.
Figure 3:
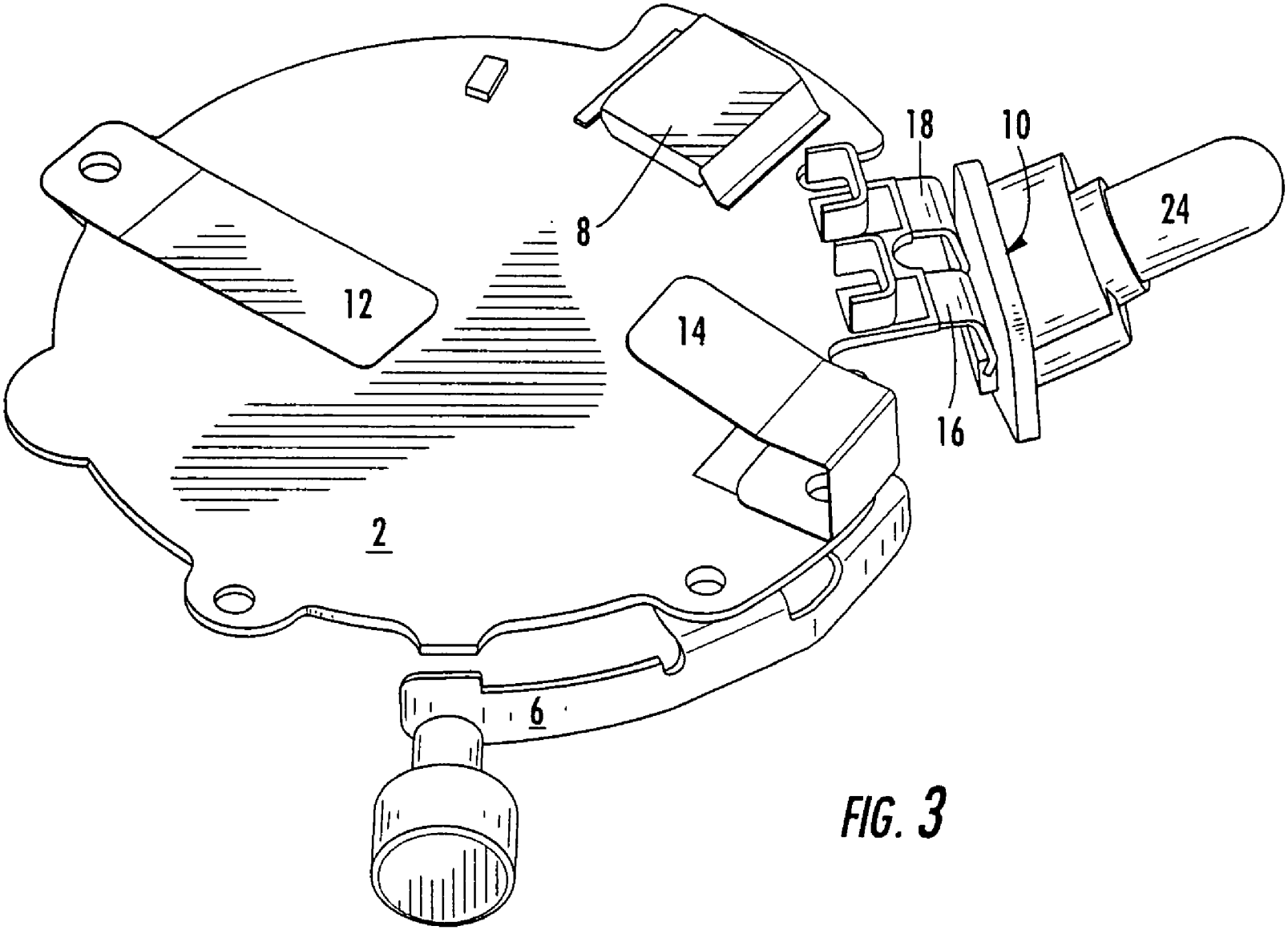
FIG. 3 is a bottom view of the illumination assembly for the illuminated watch of the present invention.
Figure 4:
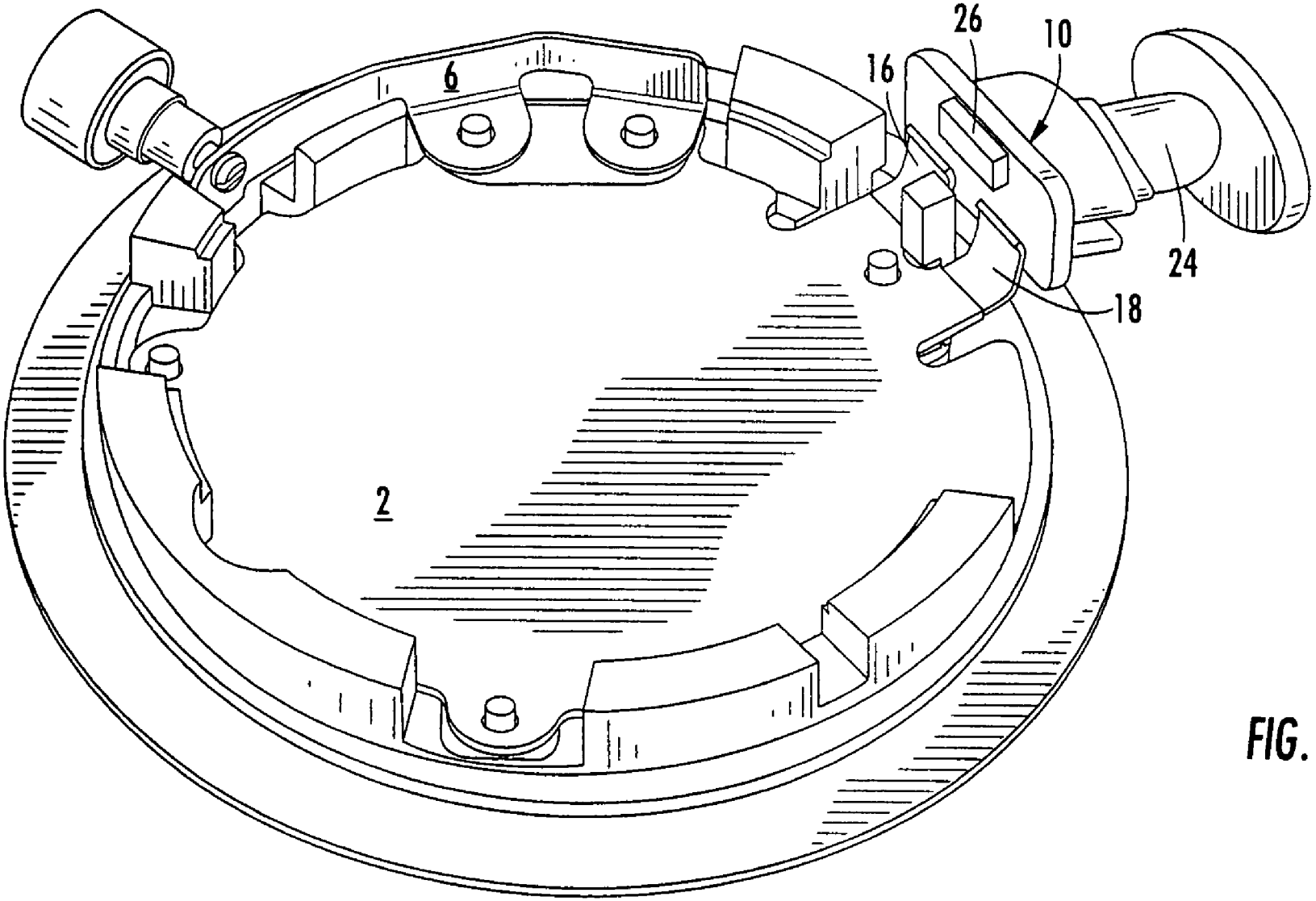
FIG. 4 is a top view of the illumination assembly for the illuminated watch of the present invention.
Figure 5:
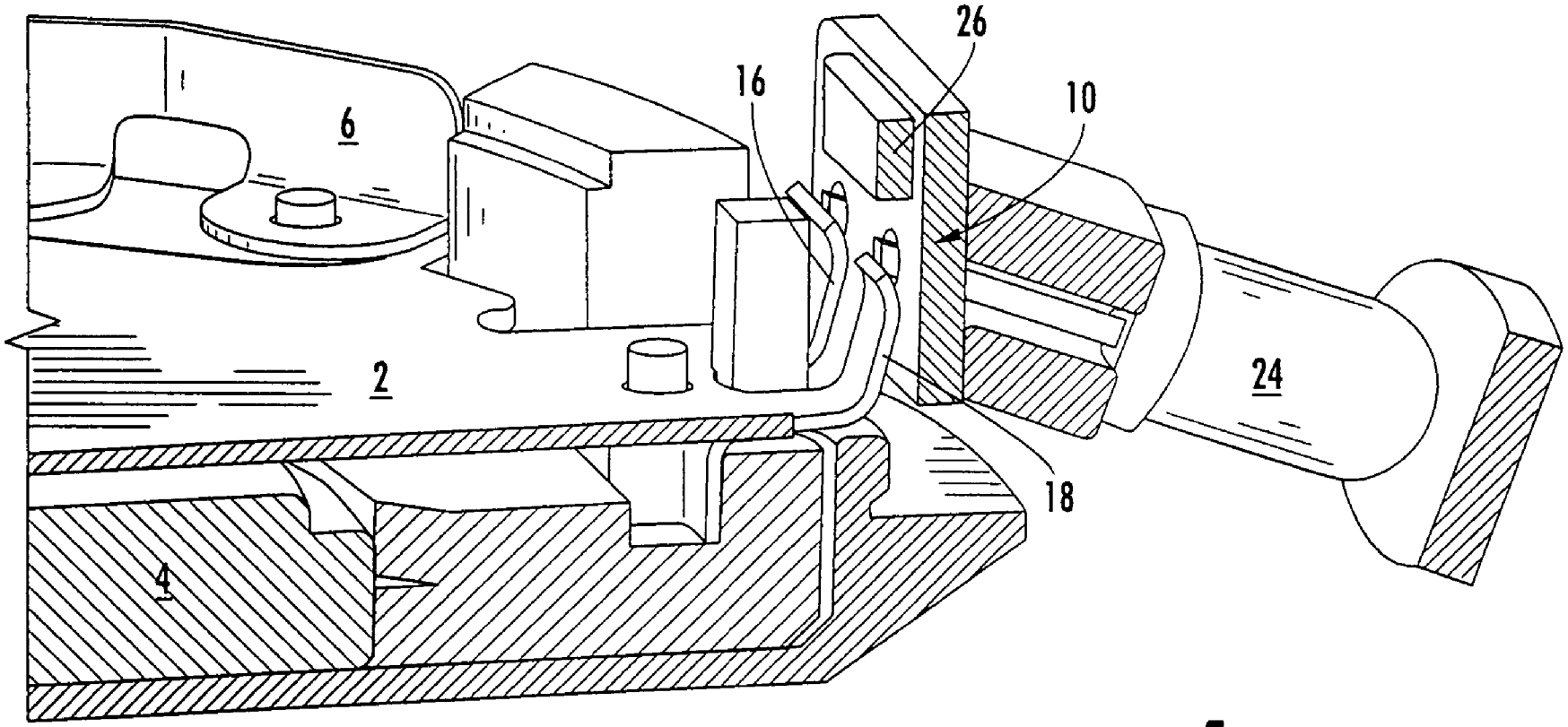
FIG. 5 is a detail view of the interface between the illumination assembly and the LED support member.
Figure 6:
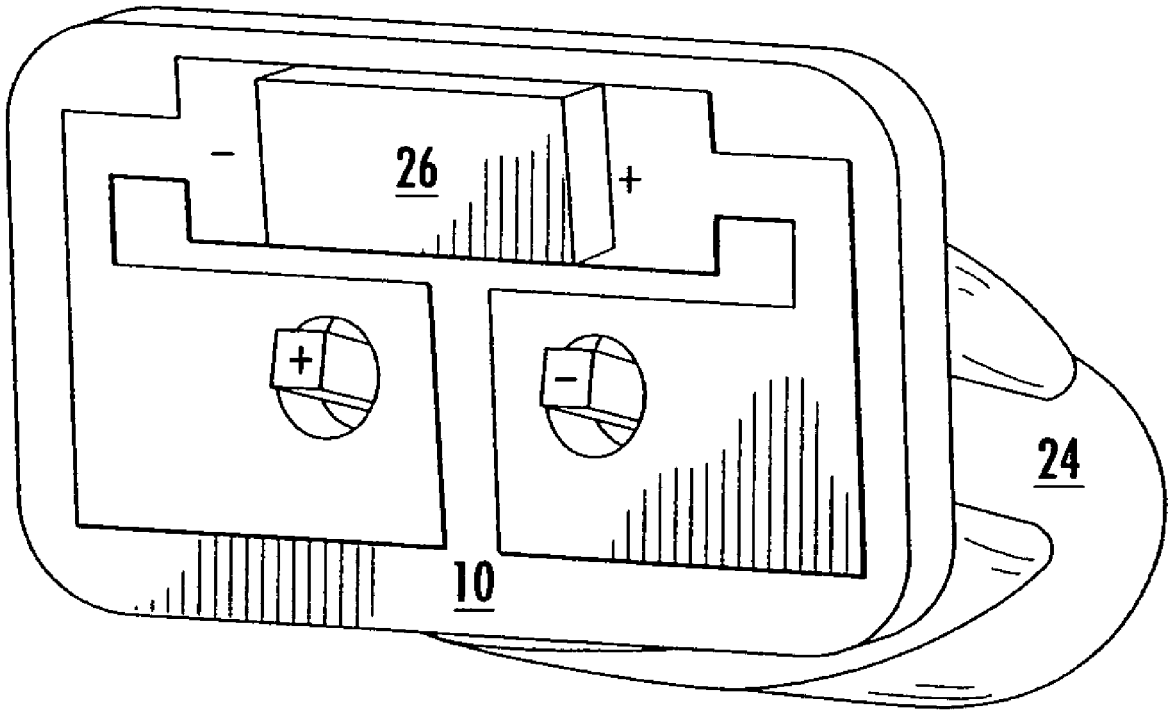
FIG. 6 is a rear view of the LED support member.

The primary assembly, seen best in FIGS. 3 and 4, is simply a circuit board 2 with the operative components mounted thereon. The required contact clips 12, 14, 16, 18 to engage the power source 4 as well as the LED support assembly 10 are clearly illustrated, as is the switch 6 in the form of a spring contact. As is best seen in the cross-sectional view of FIG. 2, the entire assembly is configured and sized so as to allow it to be mounted into a conventional type watch assembly 20. While the preferred embodiment of present invention is shown to rely on a separate battery 4 power source, the present invention also anticipates that the assembly could also get the required power by piggybacking power from the main watch 20 power source.

The primary assembly is preferably formed as a printed circuit board 2 with all of the required circuitry mounted thereon. To this end, a logic chip 8 may be mounted onto the circuit board 2 to provide the overall assembly with multi-functionality. Further battery contacts 12, 14 are provided to retain the battery 4 and supply power to the lighting assembly. Interface clips 18, 16 are provided to create electrical connectivity between the primary assembly circuit board 2 and the LED mounting assembly 10.

The LED mounting assembly 10 is configured to be placed in a side mount position in the side of the watch case 22. The mounting assembly 10 has two LED emitters 24, 26 mounted thereon. The first LED emitter 24 is a high brightness LED suitable for use as a flashlight. The LED 24 may be any acceptable color for flashlight use including but not limited to red, white, blue or green. The LED 24 is mounted to the assembly 10 so that the optical element extends through a small opening in the side of the watch case 22 towards the exterior of the watch 20 thereby serving as a flashlight when energized. The second emitter 26 is a flat or surface mount emitter having a small form factor. In the preferred embodiment, the LED 26 is a near ultraviolet emitter, although the LED 26 may be any color emitter suitable for illuminating the watch face 28. The second emitter 26 is placed onto the mounting assembly 10 opposite the first LED 24 and faces in towards the interior of the watch case 22. The second emitter 26 is positioned adjacent to an opening in the wall 22 of the watch case 22 just above the face 28 and beneath the crystal 30.

By providing the illumination assembly in two parts, the manufacturability of the watch 20 is enhanced. Since watches generally have a limited amount of available space within the case 22, it is important to provide an illumination assembly that can be installed into the case 22 without disrupting the rest of the watch 20 mechanism 29. This problem is further complicated by the fact that to provide a desirable flashlight function, the light output must be directed out the side of the watch 20 in an efficient manner. The present invention allows for a small LED mounting assembly 10 to be placed into the side of the watch case 22 before the watch mechanism 29 is installed. The primary circuit board assembly 2 is then installed into the back of the watch 20 after the watch mechanism is installed. Electrical contact between the primary circuit board 2 and the mounting board 10 is provided via spring clips 16, 18. This assembly allows for enhanced serviceability of the entire watch 20 assembly and provides for a compact and fully contained device. Further the assembly of the present invention provides for easy replacement of the battery 4 used to energize the lighting assembly as it is likely that this battery 4 will be expended at a much higher rate than the primary battery used to power the timekeeping function.

In operation, when the emitter 26 is energized, it floods 26 the face 28 of the watch with energy for a short period of time. In the preferred embodiment, the case 22 is flooded with near UV energy at a wavelength of approximately between 405 nm and 435 nm. The near UV energy energizes the phosphors deposited on the watch face 28 and the operational components such as watch hands to cause the watch 20 to illuminate. The phosphor material is selected to be particularly suited for energization by near UV energy to enhance the speed and intensity at which it energizes. While near UV is disclosed, this manner of illumination may work equally well with other LED emitter colors and other matched phosphor colors. In general principal, the phosphor simply must be matched to the output wavelength of the emitter energy used to energize it. In operation, phosphors charge up meaning that a phosphor is charged by an emitter that emits at a shorter wavelength than the output wavelength of the phosphor. Blue emitters charge green and yellow phosphors, yellow emitters charge red phosphors, etc. Therefore, in the preferred embodiment a yellow-green phosphor is utilized on the indicia while a near UV emitter is used to charge the phosphor.

The use of a near UV emitter 26 to energize and illuminate the watch dial 28 is also important as it relates to the manner in which the near UV energy impacts the user's visual system. In particular, the need for illuminating the face 28 of the watch 20 arises when the user wants to view the watch 20 in a low light environment. The user's vision in this environment is typically adjusted for some level of viewing even though the lighting may not be sufficient for viewing the indicia on the watch face 28. If the watch 20 included a means for illuminating the face 28 that utilized white light, the burst of white light, even if momentary, would disrupt the user's "night vision" adjustment. The present invention utilizes an emitter 26 to illuminate the watch face 28 that emits energy at the low end of the visual spectrum. Specifically, by emitting near UV energy, the light output is principally directed to energizing the phosphor on the watch face 28 and providing a low level of visible background illumination of the watch face 28. In this manner, the illumination function of the present invention has a low impact on the user's "night.vision" while clearly allowing the user to identify the relevant features on the watch face 28.

Another important feature of the present invention is that the particular property of LED's that causes them only to illuminate when DC current is applied in one direction allows the multifunctional feature of the watch to be achieved in a compact space. The first 24 and second 26 emitters are mounted onto a small board 10 where the positive and negative leads of each are connected in parallel in opposition to one another. In other words, the negative lead of the first LED 24 is connected to the positive lead of the second LED 26 and the positive lead of the first LED 24 is connected to the negative lead of the second LED 26. In this manner, when voltage is applied to the LED assembly 10 with one polarity, the first LED 24 will illuminate, hen the polarity is reversed the second LED 26 will illuminate. This allows the LED support assembly 20 to be connected to the circuit board 2 with only two connection leads 16,18. The logic chip 8 on the primary circuit board 2 controls the polarity in response to input from the switch 6. For example, if the switch 6 is simply pressed and released, the chip 8 may activate the UV emitter 26 to energize the watch face 28. If the switch 6 is held for more than momentary contact, the chip 8 may activate the high intensity LED 24. In this manner, any range of operational configurations may be obtained.

While the present invention discloses the most efficient manner to provide contact between the primary circuit board 2 and the LED mounting board 10, other configurations would also be anticipated within the present invention. Clearly, rather than providing two contacts 18, 16 and utilizing reverse polarity, three contacts could be provided by sharing a common negative terminal and providing two separate positive terminals. Similarly, four terminals may be provided wherein each LED contact is made discreetly.

Finally, the present invention includes a third small LED element 32 that protrudes to the exterior of the watch 20 either in the face 28 of the side of the casing 22. The third LED 32 will blink at a predetermined interval to act as a locator beacon.

Clearly, the present invention is novel in that it exploits the intrinsic operational differences between LED's and traditional filament type lamps. Previously, where package size, durability and power consumption was an issue, LED's can be incorporated to allow the enhanced functionality described herein. In particular, the low energy consumption of the LED's the long lamp life and the small size provides for a durable and compact device that could not be achieved in the prior art.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. An illuminated watch assembly comprising:

a housing, said housing having a side wall, an interior compartment, a watch crystal and channel extending through said sidewall from a first end located in said interior compartment to a second end at the exterior of the housing;

a first means for visible light illumination having a front light emitting portion and a rear portion in said interior compartment, wherein light from said front light emitting portion is directed through said channel exiting said first end to the exterior of the housing;

a watch mechanism installed in said interior compartment, said watch mechanism having a face which is visible through said watch crystal;

a second means for near ultraviolet illumination in said interior compartment positioned adjacent the rear portion of said first means of illumination and said second end of said channel, wherein light from said second means for illumination is directed into a space defined between said face and said watch crystal;

at least one power source in said interior compartment, said at least one power source providing power for said watch mechanism, said first means for illumination and said second means for illumination; and a means for selectively and independently energizing said first and second means for illumination.

2. The illuminated watch assembly of claim 1, further comprising:

indicia disposed on said face, said indicia formed from a phosphorescent material, wherein said phosphorescent material is charged by said near ultraviolet illumination thereby causing said phosphorescent material to glow.

3. The illuminated watch assembly of claim 1, wherein said first and second means for illumination are light emitting diodes.

4. The illuminated watch assembly of claim 3, wherein said first light emitting diode has an output color, said color selected from the group consisting of white, red, blue, yellow and combinations thereof.

5. The illuminated watch assembly of claim 3, wherein said first light emitting diode is white and said second light emitting diode has a peak output of approximately 435 nm.

6. The illuminated watch assembly of claim 1, said at least one power source comprising:

a first power source providing power for said watch mechanism; and a second power source providing power for said first and second means for illumination.

7. An illumination assembly for a watch, said watch having a housing, said housing having a side wall, an interior compartment, a watch crystal, a channel extending through said sidewall from a first end located in said interior compartment to a second end at the exterior of the housing and a watch mechanism installed in said interior compartment, said watch mechanism having a face visible through said watch crystal, said illumination assembly comprising:

a first means for visible light illumination having a front light emitting portion and a rear portion in said interior compartment, wherein light from said front light emitting portion is directed through said channel exiting said first end to the exterior of the housing;

a second means for near ultraviolet illumination in said interior compartment positioned adjacent the rear portion of said first means of illumination and said second end of said channel, wherein light from said second means for illumination is directed into a space defined between said face and said watch crystal;

at least one power source in said interior compartment, said at least one power source providing power for said timepiece, said first means for illumination and said second means for illumination; and a means for selectively and independently energizing said first and second means for illumination.

8. The illumination assembly for a watch of claim 7, wherein said watch face includes indicia disposed thereon, said indicia formed from a phosphorescent material, wherein said phosphorescent material is charged by said near ultraviolet illumination thereby causing said phosphorescent material to glow.

9. The illumination assembly for a watch of claim 7, wherein said first and second means for illumination are light emitting diodes.

10. The illumination assembly for a watch of claim 9, wherein said first light emitting diode is white and said second light emitting diode has a peak output of approximately 435 nm.

11. The illumination assembly for a watch of claim 7, said at least one power source comprising:

a first power source providing power for said timepiece; and a second power source providing power for said first and second means for illumination.

* * * * *